US006352393B1

(12) United States Patent
Sanders

(10) Patent No.: US 6,352,393 B1
(45) Date of Patent: Mar. 5, 2002

(54) APPARATUS FOR TRANSPORTING LOOSENED PARTICULATE MATERIAL USING FLUID UNDER PRESSURE

(75) Inventor: Trevor George Sanders, Wokingham (GB)

(73) Assignee: Thames Water Utilities Limited, Berks (GB)

( * ) Notice: Subject to any disclaimer, the term of this patent is extended or adjusted under 35 U.S.C. 154(b) by 0 days.

(21) Appl. No.: 09/206,696

(22) Filed: Dec. 7, 1998

(30) Foreign Application Priority Data

Dec. 5, 1997 (GB) ..... 9725958

(51) Int. Cl.[7] ..... B65G 53/42

(52) U.S. Cl. ..... 406/152; 406/83; 406/113; 175/215

(58) Field of Search ..... 406/83, 113, 152, 406/153, 181, 157; 175/215

(56) References Cited

U.S. PATENT DOCUMENTS

| | | | | | |
|---|---|---|---|---|---|
| 2,301,617 | A | * | 11/1942 | Cox et al. | 302/58 |
| 2,744,792 | A | * | 5/1956 | Finn | 302/14 |
| 3,273,401 | A | * | 9/1966 | Kaufmann et al. | 73/421 |
| 3,301,606 | A | * | 1/1967 | Bruno | 302/58 |
| 3,360,061 | A | * | 12/1967 | Canalizo | 175/324 |
| 3,638,741 | A | * | 2/1972 | Zizak | 175/215 |
| 3,825,082 | A | * | 7/1974 | Woodruff | 175/211 |
| 3,959,845 | A | * | 6/1976 | Cradeur et al. | 15/321 |
| 4,776,731 | A | * | 10/1988 | Briggs et al. | 406/153 |
| 4,936,031 | A | | 6/1990 | Briggs et al. | |
| 4,991,321 | A | | 2/1991 | Artzberger | |
| 5,361,855 | A | | 11/1994 | Schuermann et al. | |
| 5,865,568 | A | * | 2/1999 | Relin et al. | 406/85 |

FOREIGN PATENT DOCUMENTS

| | | |
|---|---|---|
| GB | 2 256 667 A | 12/1992 |
| GB | 2 256 667 | 12/1992 |

* cited by examiner

*Primary Examiner*—Christopher P. Ellis
*Assistant Examiner*—Joe Dillon, Jr.
(74) *Attorney, Agent, or Firm*—Lowe Hauptman Gilman & Berner, LLP

(57) ABSTRACT

The invention relates to apparatus for transporting loosened soil from a hole, trench or excavation, comprising a probe device and internal nozzles which are spaced from a distal end of the probe device and are directed towards the longitudinal axis of that probe device. Air pulsed through the nozzles lifts the soil along the tube to a discharge chamber.

15 Claims, 6 Drawing Sheets

APPARATUS FOR TRANSPORTING LOOSENED PARTICULATE MATERIAL USING FLUID UNDER PRESSURE

The invention relates to excavation apparatus, particularly to apparatus for transporting loosened soil, namely soil which is previously loosened.

It will be understood that the term "soil" used herein relates to earth, ground, sand, clay, silt or the like substrate in which plants may grow and service equipment such as pipe, ducts, cables, and conduits may be buried. Thus it is often necessary to be able to reach an underground or buried pipe, duct, conduit or cable (hereinafter pipe), or to free the roots of say a tree.

Moreover, even when the ground is relatively readily diggable, it is often the case that using a digger can damage the pipe because the operator is not able to see the buried pipe and is therefore operating "blind" to a degree when removing loosened soil.

It is accordingly an object of the invention to seek to mitigate these disadvantages.

According to the invention there is provided apparatus for transporting loosened soil, comprising a probe device for insertion into the soil and a nozzle adjacent the free end thereof and adapted to be connected with a source of fluid under pressure, the arrangement being such that in use when the probe device is inserted into the soil and fluid under pressure exits the nozzle, loosened soil around the probe device passes into the probe device for transport therealong.

There may be a plurality of nozzles spaced apart around the probe device. This provides for an even transport of the loosened soil, particularly when the probe device may be cylindrical and there may be four nozzles spaced equiangularly around the circumference thereof.

The probe device may comprise a tube.

A construction embodying the invention thus provides for transporting loosened soil away from the top of the probe device, suitably to a convenient position above ground.

The tip of the probe device may extend beyond the outlets of the respective nozzles, whereby loosened soil is directed in to the tube. This construction provides for enhanced transport of loosened soil.

The tip of the probe device may comprise teeth means whereby to enhance initial entry of the probe device into the soil. This construction enhances entry into the soil and can provide an initial loosening.

The outlet of a respective nozzle may be directed towards the cylindrical axis of the tube. This construction can provide enhanced flow of loosened soil into the tube, as the direction of flow of the loosened soil can only be up the tube, as the surrounding soil prevents movement in any other direction.

There may be additional means adapted to enhance conveyance of soil through the tube away from the tip. This construction can promote flow of loosened soil along the tube.

The additional means may comprise means for injecting a fluid under pressure into the tube in a direction away from the tip. This construction can then reinforce the flow of fluid from the nozzles which loosen the soil.

The injection means may comprise at least one additional nozzle. This provides for positive transporting of the loosened soil, particularly where there may be a plurality of additional nozzles arranged circumferentially of the tube, or alternatively the injection means may comprise a plurality of nozzles arranged longitudinally of the tube.

The tube may open into a discharge device for the soil. This device may suitably have a larger volume than the tube, so that the tube does not become clogged with soil in use.

The discharge device may comprise a chamber into which the soil is diverted from the tube.

There may be diverter means adjacent an end of the tube for diverting flow of soil into the chamber. This provides for positive flow of loosened soil into the chamber.

The diverter means may suitably comprise a face of a cone which is inclined to the longitudinal arm of the tube. This provides a relatively simple construction whereby when loosened soil strikes the face, it is deflected towards the chamber from the tube.

There may be a valve means between the tube and the chamber. This construction can prevent backflow of loosened soil into the tube.

To this end, the valve means may comprise a flap valve opening into the chamber, preferably a rubber sheet. This is a relatively simple yet efficient construction.

There may be means to enhance transport of the soil by the respective nozzle(s). This construction is relatively advantageous, particularly where said means may comprise rotatable means suitably in the form of a wire brush or brushes, or toothed wheel(s).

There may be means to support the apparatus in use. This relieves strain on an operator, particularly when the means may comprise balancing means adapted to support the apparatus and allow manipulation thereof by an operator, The balancing means may be adapted for suspension from a support. Thus the apparatus may be suspended from a digger or dumper.

There may be a device for facilitating movement of the tube in use, suitably a handle.

There may also be means to vibrate the tube This provides for enhancement of insertion into the loosened soil.

There may also be means to turn the tube about its longitudinal axis during use.

There may be means to enhance drying of transported loosened soil. This is important when the removed soil is to be as dry as possible.

The said means may comprise a suction tube adapted for connection with a drainage pump.

The apparatus may be connected with a source of fluid under pressure, suitably an air source.

Apparatus for transporting loosened soil is hereinafter described, byway of example, with reference to the accompanying drawings.

Figure 1:
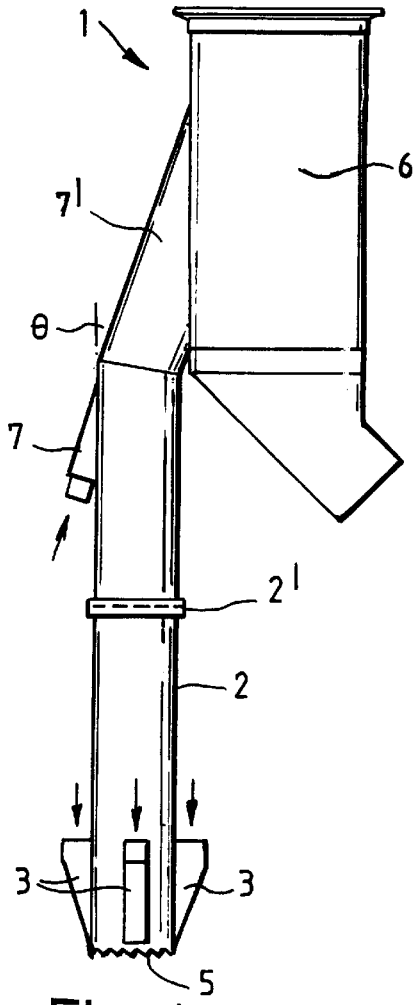
FIG. 1 is a side elevational view of apparatus according to the invention for loosening soil.
Figure 2:
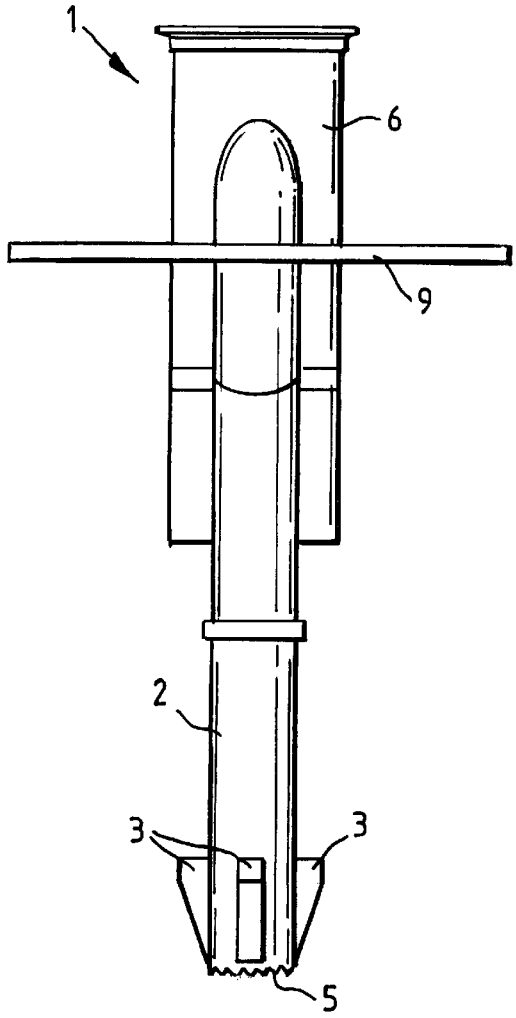
FIG. 2 is a front elevational view of the apparatus of FIG. 1.

Referring to the drawings, in which like reference numerals refer to like integers, there is shown apparatus 1 for transporting loosened soil, comprising a probe device 2 for Insertion into the soil and nozzle 3, which may be an insert 4 supported by the probe device 2 adjacent the free end thereof and adapted to be connected with a source of fluid under pressure (not shown) the arrangement being such that in use when the probe device 2 is inserted into the soil and fluid under pressure exits the nozzle 3, the loosened soil around the probe device 2 passes into the probe device for transport therealong.

In the embodiments shown in FIGS. 1–8, the probe device 2 is in the form of a tube, and there are four nozzles 3 spaced equiangularly around the circumference thereof with their outlets terminating short of the tip of the probe device, the nozzle outlets being directed downwardly in use and angled or directed towards the longitudinal axis of the tube device 2. The tip 5 of the tube 2 is castellated, serrated or toothed to provide for initial ease of insertion into the soil prior to a soil transporting or excavating action. The length of the tube 2 is such that it extends above ground where an angled part leads to a collection and discharge chamber 6 of greater volume and cross-section than the tube so that soil can be led away to a point of disposal, for example a tanker (not shown).

Figure 15:
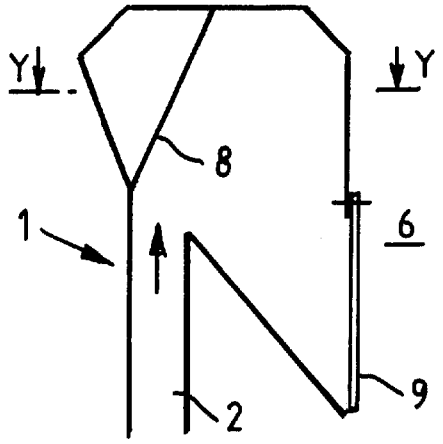
FIGS. 15 and 16 show respectively to an enlarged scale diverter means and valve means of apparatus according to the invention.
Figure 16:
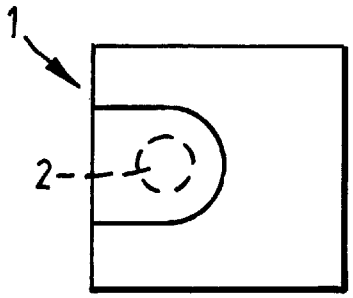

There are additional nozzles 7 providing flow enhancers which are angled into the tube 2 at a position adjacent the upper (in use) end and which enhance flow of loosened soil as will be described There may be air flow (in the embodiment air is the preferred fluid) into the tube 2 at various points, as shown by the arrows 7 in FIGS. 10 to 14 and 20. Internally of the tube there is a diverter or deflector means 8 which in the embodiment is in the form of an inclined surface of a cone at a bend of the tube 2 leading to the chamber 6, as shown in FIG. 15, there being a valve means in the form of a flap valve 9, suitably a rubber sheet over an entry to the discharge chamber 6 and which allows passage of soil into the discharge chamber 6 whilst obviating in the embodiment flow of soil back down the tube 2.

Figure 3:
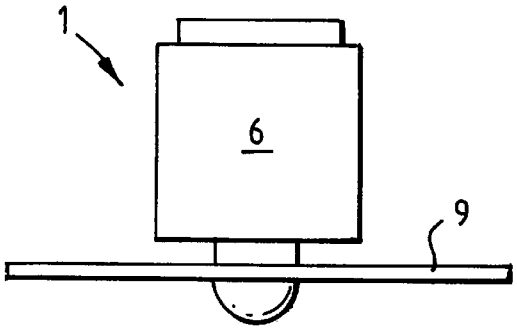
FIG. 3 is a top plan view of the apparatus of FIGS. 1 and 2.
Figure 2A:
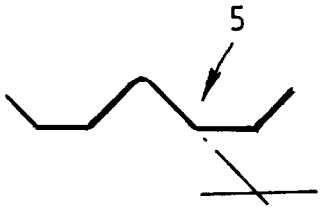
FIG. 2A is an enlarged view of part of FIG. 2.
Figure 4:
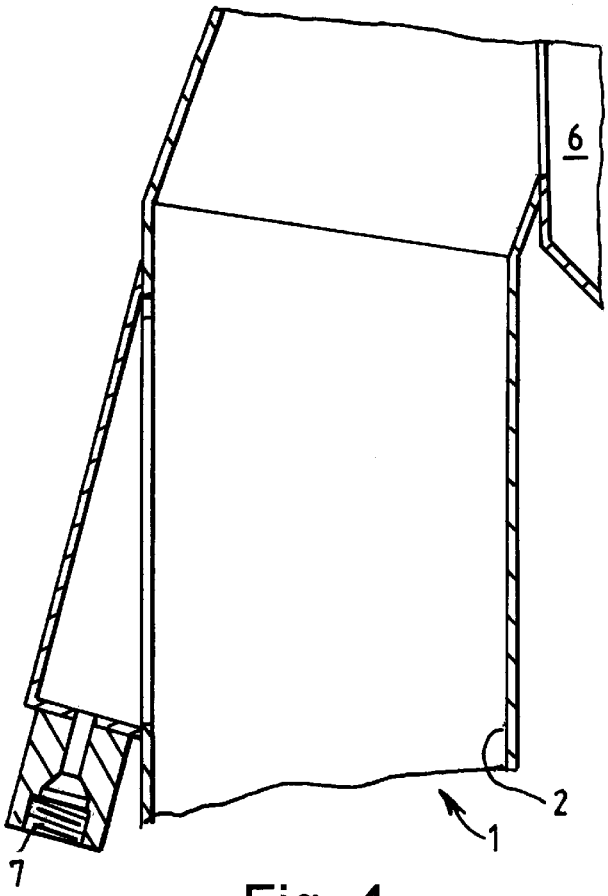
FIG. 4 is an enlarged view in longitudinal section of part of the apparatus of FIGS. 1 to 3.
Figure 5:
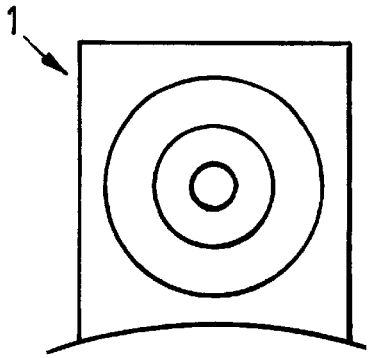
FIG. 5 is a view on arrow 'A' of FIG. 4.
Figure 6:
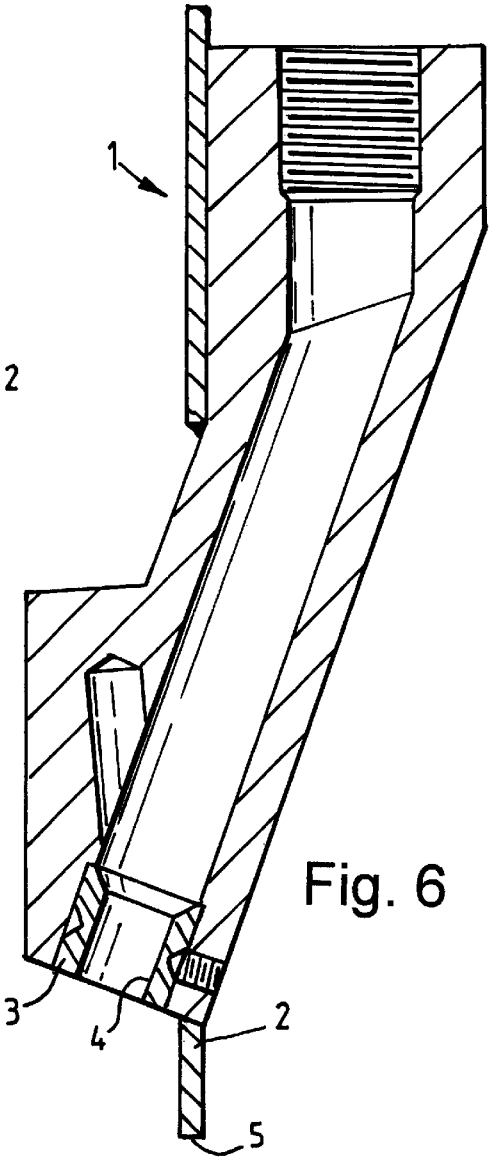
FIG. 6 is a schematic side elevational partly in section view of the apparatus of FIGS. 1 to 5.
Figure 7:
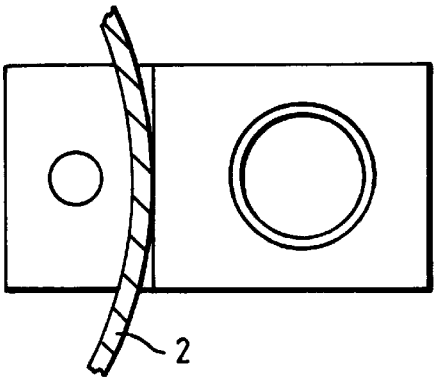
FIG. 7 is a view from below of FIG. 6.
Figure 8:
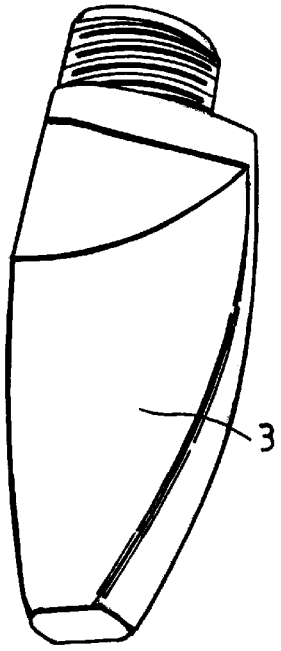
FIG. 8 shows a schematic interior view to an enlarged scale of a nozzle for use in the apparatus of FIGS. 1 to 7.
Figure 17:
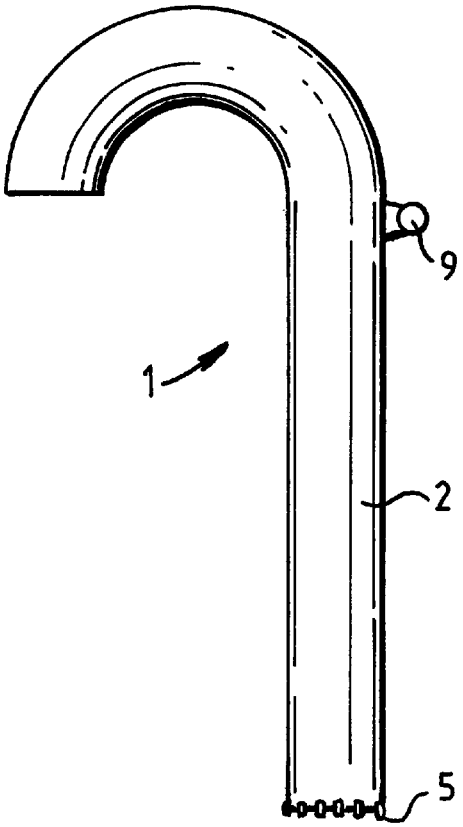
FIGS. 17 and 17A show a further modification of apparatus according to the invention.
Figure 17A:
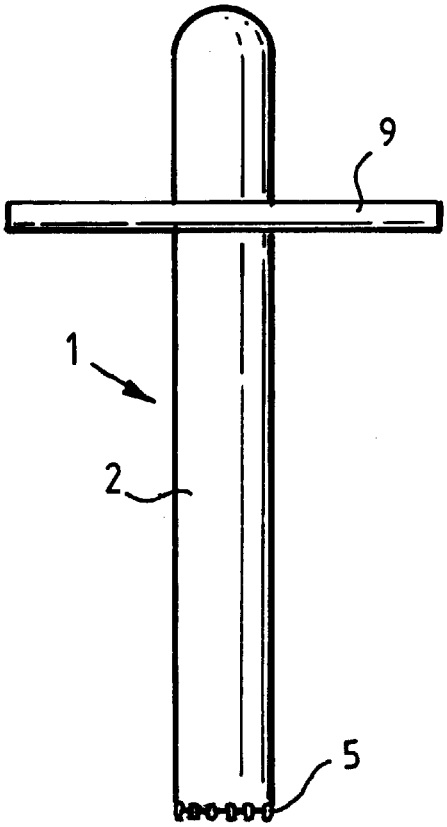
Figure 18:
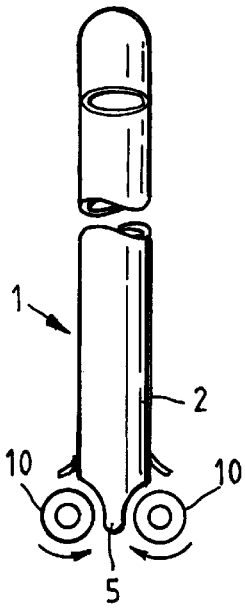
FIGS. 18 and 19 show a yet further modification of apparatus according to the invention.
Figure 19:
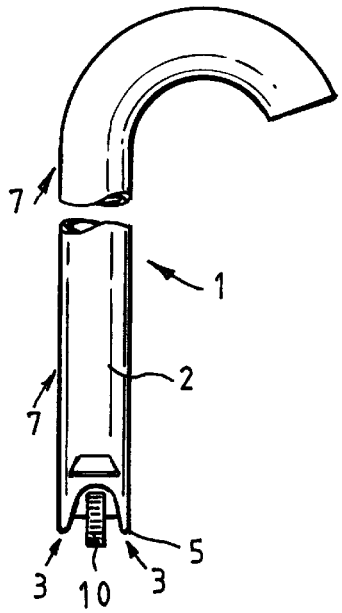

There is a handle 9, FIGS. 3, 17, 17A which enable an operator to provide rotation or turning of the tube 2 so that the tube 2 can be twisted clockwise and anti-clockwise thereby grinding or screwing the tip 5 of the tube 2 into the soil, which is enhanced by the serrations. It will be understood that in a modification (not shown), there could be power means such as a pneumatic actuator positioned between the handle 9 and the tube 2 for effecting a powered rotation of the tube, to enhance soil penetration.

The penetration can be enhanced by additional soil loosening means adjacent the serrated tip, in the form of rotatable devices such as a pair of contra-rotatable wire brushes or toothed wheels 10, the rotation of which is in a direction such as to enhance flow of loosened soil into the tube 2.

The apparatus 1 may also be supported by suitable means such as a balancer (not shown) to lighten the load of an operator. The balancer would support most of the weight of the apparatus, thereby allowing for ease of movement of the whole apparatus 1 by an operator. The balancer could be mounted on suitable plant such as the hook of a crane lorry, or a bucket of a 360° excavator, both of which could be used for various other operations connected with an excavating operation. Moreover, the tube 2 may be vibrated by vibrating means such as a post-driver attached to the side of the tube. Vibration would then be transmitted to the tip of the tube, which enhances soil penetration.

Figure 20:
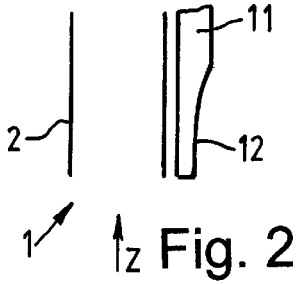
FIGS. 20 and 20A show a yet further modification of apparatus according to the Invention.
Figure 20A:
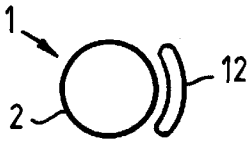

Moreover, it is usually beneficial to maintain the removed soil, or spoil, removed from a hole which is excavated as dry as possible. To this end, a drainage means such as a drainage pump (not shown) could be mounted on the tube 2 at a high level, In other words spaced from the tip, the pump having a suction hose 11 secured along the length of the tube and terminating adjacent the tip of the tube 2. The end of the hose 11 remote from the pump is flattened or squashed at 12, (FIGS. 20, 20A, which latter is a view on arrow "Z" of the former) thereby providing a smaller footprint for the whole of the apparatus.

Figure 9:
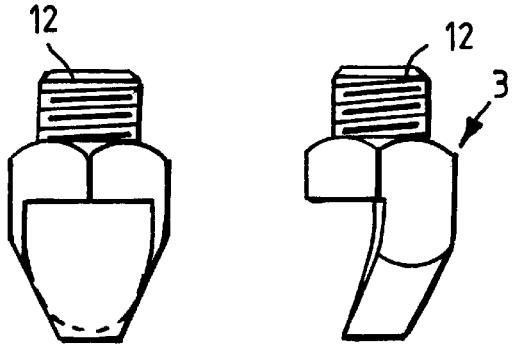
FIG. 9 shows developed views of the nozzle of FIGS. 8.
Figure 10:
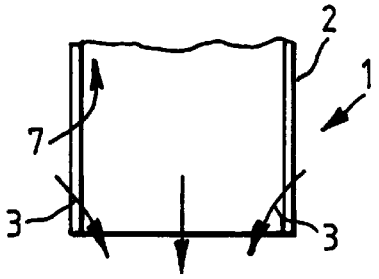
FIGS. 10 and 11 show respectively and schematically the direction of air flow from the nozzles and into the tube of apparatus according to the invention.
Figure 11:
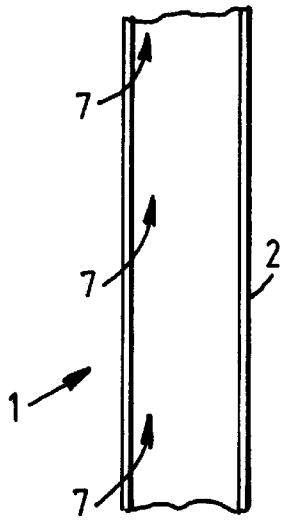
Figure 12:
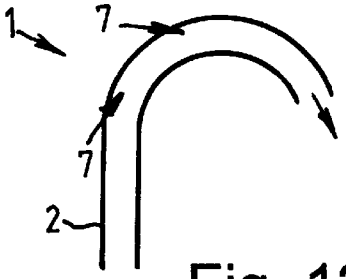
FIGS. 12 to 14 show schematically views of different embodiments of tubes used in apparatus according to the invention.
Figure 13:
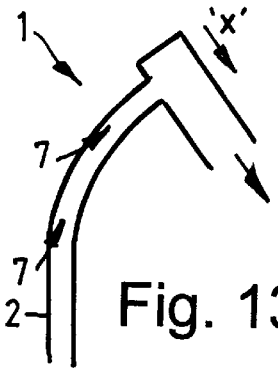
Figure 13A:
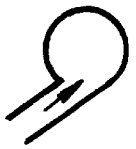
Figure 14:
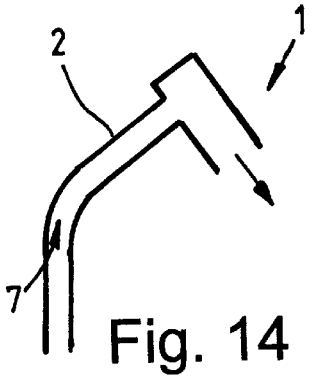

The nozzles 3 may each have a hollow screw thread 12 (FIGS. 8, 9) for screwing into a drill hole there being a spring or cone angle of about 45°.

Figure 21:
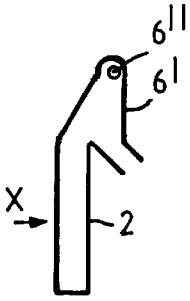
FIGS. 21, 21A and 21B show schematically an alternative collection and discharge chamber, FIG. 21A being a view on arrow "x" of FIG. 21.
Figure 21A:
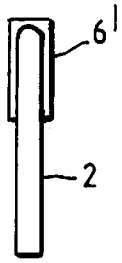
Figure 21B:
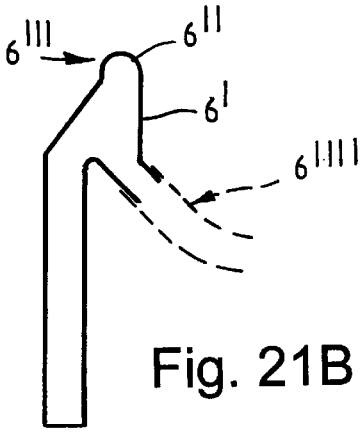

Referring now to FIGS. 21–21B, there is shown an embodiment in which the collection and discharge chamber is smaller than that of for example FIGS. 1–8. In FIGS. 21–21B, the chamber 6' is of only slightly greater lateral dimension than the tube 2, and has a curved, domed or radiussed extension 6" which enhances flow of soil up the tube 2, and guides it round and into the chamber 6'. Any tendency for loosened transported soil to become clogged in the extension 6" can be obviated by use of an optional jet of air from a nozzle 6''', shown schematically, which provides a regular, or constant, air blast into the extension, the blast being directed in the direction of the soil flow up the tube 2 and into the chamber 6'. As shown in FIG. 21B, there may be a flexible tube, conduit or duct 6'''' leading from an outlet of the chamber 6'. The tube 6'''' allows soil debris to be directed in a particular direction for disposal, and also assists in damping or attenuating noise.

Figure 22:
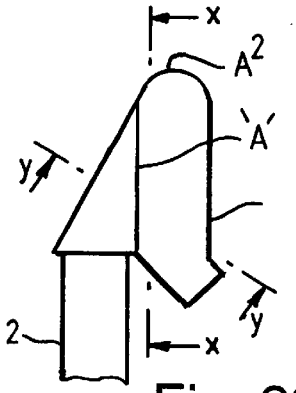
FIGS. 22, 22A and 22B show schematically a yet further embodiment of apparatus according to the Invention, FIGS. 22A and 22B being respectively taken on section x—x and y—y of FIG. 22.
Figure 22A:
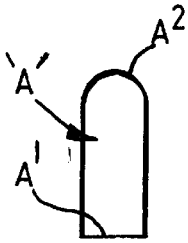
Figure 22B:
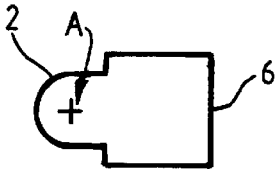

Turning now to FIGS. 22–22B, there is shown an embodiment in which the configuration of the aperture 'A' between the tube 2 and chamber 6 or 6' is wider than that in FIG. 1, having an entry A' of similar diameter as that of the tube 2 and a smoother, wider curved exit $A^2$ into the chamber 6 or 6", thereby providing a smoother flow of transported loosened soil.

Figure 23A:
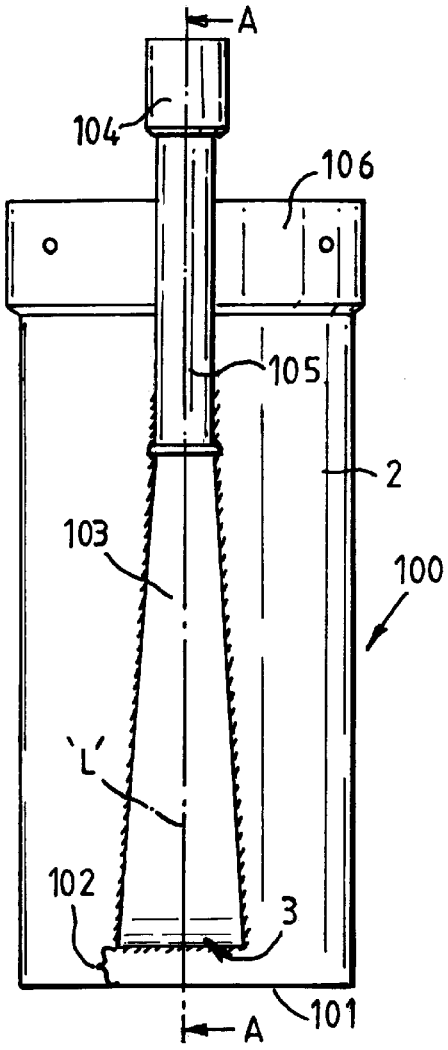
FIGS. 23 and 23A show respectively side elevational and longitudinal sectional views of apparatus according to the invention.
Figure 23B:
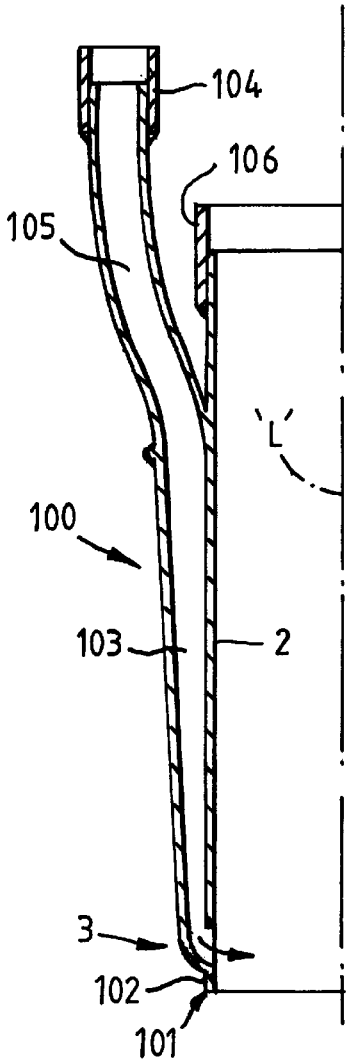

Turning now to the embodiment of FIGS. 23 and 23A, there is shown a further embodiment of apparatus 100 embodying the invention. The nozzle 3 comprises in this embodiment two diametrically opposed nozzles giving into the tube 2 whereby to provide an air blast or jet, directed downwardly as shown by arrow 'D' towards the longitudinal axis 'L' of the tube 2, the nozzles 3 being spaced from the lower end 101, in use of the tube 2, by a part or foot 102. The nozzles 3 are each supplied with air, usually pulsed, from a conduit 103 which is secured as by welding to a socket 104 by a sinuous conduit 105. The conduit 103 is flared downwardly as shown to supply the nozzle(s), and is secured to the tube 2 as by welding, for example as by a fillet weld.

Such a weld secures the socket 104 and sinuous conduit 105 together, and a similar weld secures a socket 106 on the tube or pipe 2 thereto.

In use, the nozzles 3 and 7 are connected to a source of compressed air in a pressure vessel. The tube 2 is Inserted into the ground or "stabbed" at a point where excavation is to be carried out, and the soil has been previously loosened by any suitable means. Thus insertion can take place over or adjacent a buried pipe, and, on actuation of the air, pulses of air are triggered to exit the nozzles 3 as air blasts which act on the loosened soil, a substantial proportion of which loosened soil is directed towards and lifted into the tube at its tip 5 and transported therealong, the flow of loosened soil into the mouth 5 being enhanced in the angled flow of air towards the mouth 5 from the inwardly directed nozzle outlets. Further flow enhancement is achieved by the nozzles 7 which direct air impulses into the tube so that the soil is carried along the tube 2, strikes diverter 8 and passes into the chamber 6 through the flap valve 9. The air impulses from the nozzles 7 thus act to aspirate the apparatus and enhance the flow of loosened soil upwardly through the tube 2 towards and into the chamber 6.

The air jets from the nozzles 7 may be in phase with or out of phase with the air jets from the loosening nozzles 3. Also, the air feed to the different nozzles may be from the same source of air under pressure or may be fed from separate sources. Also, the nozzles 3, 7 may be connected, while the nozzles 3 may be fed with air from an annular manifold (not shown) at the tip 5.

In all embodiments, the air is elected from a respective nozzle 3 as a sudden blast, but the pressure and the size of the nozzles 3 is such that no damage is caused to the buried pipe, which is however exposed for say maintenance.

Figure 24:
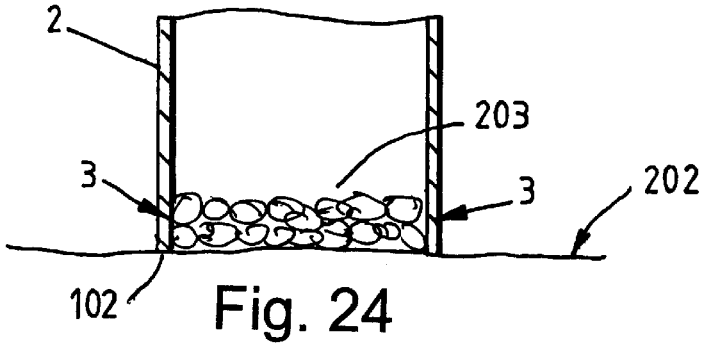
FIG. 24 shows schematically to an enlarged scale, use of all embodiments of apparatus according to the invention.

Thus in all the embodiments, the foot 102 (FIG. 24, though it applies to all embodiments) makes effectively a "seal" with the ground surface, i.e. that surface 202 at the bottom of a hole or excavation, whereby the air pulses from the nozzle(s) 3 provides flow of loosened soil, or spoil, 203 up the tube 2 for transport and disposal.

The apparatus may also be used for excavating a simple hole, or for transporting loosened soil to provide a trench.

It will be understood that modifications may be possible. Thus if the angle Θ, FIG. 1, is less than 20°, then the nozzle(s) 7 may be dispensed with as the loosened soil being transported up inclined pipe or tube 7' (FIG. 1) is self-cleaning; stated in another way, the soil will pass up tube 2 into the chamber 6 without the need for additional air assistance.

Also, it will be understood that the tube 2 may be a single tube or it can be in a plurality of sections joined at flanges 2'. This enables the tube to be lengthened as required by the Insertion of an extension piece, not shown, which has at least one flange for connection with the upper, as viewed, flange 2', though it may have a lower, in use flange for connection with the lower (as viewed) flange 2'. This provides for use in excavation, e.g. holes, of different depths, in other words a longer tube 2 is used in deeper holes.

It will be understood too that for a one-person operation, mechanical assistance such as the balancing means referred to hereinbefore will usually be used.

Thus using the embodiments of the invention hereinbefore described with reference to the accompanying drawings, it is possible to reduce the cost of excavation, with minimal disruption, the invention essentially providing "key hole" technology in the field to excavate site specific locations with reduced cost.

Thus, in summary, the air pulse delivered via the nozzle(s) 3 is in the form of a shock wave which in the embodiment of FIGS. 23 & 23A for example provides two outlet areas adjacent previously loosened soil which areas are part of the transport system, the air being supplied from pressurised receivers. The shock wave, impinging on the loosened soil, forces it upwardly through the pipe 2, which is generally vertically arranged. There is a bend or chute 7', 6" which directs the transported soil to the discharge chamber Large soil debris such as stones, half house-bricks etc. can be transported by apparatus embodying the invention, the tube 2 in a preferred embodiment having a diameter of about 160 mm.

I claim:

1. Apparatus operatively designed to transport loosened particulate material, comprising:

(i) a probe device having a free end for insertion into particulate material and a passage for loosened particulate material; and (ii) at least one nozzle adjacent the free end of the probe device and adapted to be connected with a source of fluid under pressure, whereby in use when the probe device is inserted into the particulate material and fluid under pressure exits the nozzle(s), loosened particulate material around the probe device passes into the probe device for passage therealong, wherein all of the outlet(s) of the nozzle(s) are structured for directing said fluid under pressure during use only in directions downwards and inwards towards a longitudinal axis of the free end of the probe device, whereby to provide enhanced flow of loosened particulate material; and (iii) diverter means, at an end opposed to said free end and inclined relative to said longitudinal axis, in the probe device for diverting the flow of particulate material.

2. Apparatus as defined in claim 1, wherein the probe device comprises a tube.

3. Apparatus as defined in claim 1, wherein the probe device comprises a tip which extends beyond the outlet(s) of the respective nozzle(s), whereby loosened particulate material is directed into the probe device.

4. Apparatus as defined in claim 1, wherein the free end of the probe device comprises teeth means whereby to enhance initial entry of the probe device into the particulate material.

5. Apparatus as defined in claim 1, wherein said particulate material comprises soil.

6. Apparatus as defined in claim 1, wherein said particulate material comprises stones.

7. Apparatus as defined in claim 1, wherein said particulate material comprises half house-bricks.

8. Apparatus as defined in claim 3, wherein there is additional means adapted to enhance conveyance of loosened particulate material through the probe device in an upwards direction away from the free end of the probe device.

9. Apparatus as defined in claim 8, wherein the additional means comprises means for injecting a fluid under pressure into the probe device in the direction away from the free end of the probe device.

10. Apparatus as defined in claim 9, wherein the injection means comprises at least one additional nozzle positioned above said nozzle(s) which are adjacent the free end of the probe device.

11. Apparatus as defined in claim 9, wherein there is a plurality of additional nozzles arranged circumferentially of the probe device.

12. Apparatus as defined in claim 1, wherein the probe device opens into a discharge device for the particulate material.

13. Apparatus as defined in claim 12, wherein the discharge device comprises a chamber into which the particulate material is diverted from the probe device.

14. Apparatus as defined in claim 13, wherein there is diverter means adjacent an end of the probe device for diverting flow of particulate material into the chamber.

15. Apparatus as defined in claim 14, wherein the diverter means comprises a face of a cone which is inclined to the longitudinal arm of the probe device.

* * * * *